US007645730B2

(12) United States Patent
Baldridge et al.

(10) Patent No.: US 7,645,730 B2
(45) Date of Patent: Jan. 12, 2010

(54) SURFACTANT COMPOSITION WITH A REDUCTION OF SURFACE TENSION, INTERFACIAL TENSION, AND CRITICAL MICELLE CONCENTRATION USING A PROTEIN-BASED SURFACTANT SYNERGIST

(75) Inventors: John W. Baldridge, Newport Beach, CA (US); Carl W. Podella, Irvine, CA (US)

(73) Assignee: Advanced BioCatalytics Corp., Irvine, CA (US)

( * ) Notice: Subject to any disclaimer, the term of this patent is extended or adjusted under 35 U.S.C. 154(b) by 291 days.

(21) Appl. No.: 11/322,104

(22) Filed: Dec. 28, 2005

(65) Prior Publication Data

US 2006/0270583 A1 Nov. 30, 2006

Related U.S. Application Data

(63) Continuation-in-part of application No. 10/837,312, filed on Apr. 29, 2004.

(60) Provisional application No. 60/639,279, filed on Dec. 28, 2004.

(51) Int. Cl.
*C11D 3/00* (2006.01)

(52) U.S. Cl. ..... 510/392; 252/186.25; 435/183; 435/188; 435/255.1; 435/255.2; 435/255.4; 435/255.5; 435/255.6; 510/214; 510/320; 510/321; 510/393

(58) Field of Classification Search ..... 210/632–764; 510/302–530, 214; 252/186.25; 435/183, 435/188, 255.1, 255.2, 255.4, 255.5, 255.6
See application file for complete search history.

(56) References Cited

U.S. PATENT DOCUMENTS

| | | | | |
|---|---|---|---|---|
| 2,320,479 | A | 6/1943 | Sperti | |
| 3,404,068 | A | 10/1968 | Battistoni | |
| 3,635,797 | A | 1/1972 | Battistoni et al. | |
| 4,771,003 | A * | 9/1988 | Stellwag et al. | 435/221 |
| 5,238,925 | A | 8/1993 | Bentley | |
| 5,356,874 | A | 10/1994 | Bentley | |
| 5,514,591 | A | 5/1996 | Levin | |
| 5,714,169 | A | 2/1998 | Levin | |
| 5,820,758 | A | 10/1998 | Dale et al. | |
| 5,849,566 | A | 12/1998 | Dale et al. | |
| 5,885,950 | A | 3/1999 | Dale et al. | |
| 5,897,928 | A | 4/1999 | Sanders et al. | |
| 6,033,875 | A | 3/2000 | Bussineau et al. | |
| 6,046,152 | A * | 4/2000 | Vinson et al. | 510/428 |
| 2001/0044397 | A1 * | 11/2001 | Berry et al. | 510/302 |
| 2003/0047510 | A1 * | 3/2003 | Baldridge et al. | 210/632 |
| 2004/0180411 | A1 * | 9/2004 | Podella et al. | 435/71.1 |
| 2006/0049119 | A1 * | 3/2006 | Ludensky et al. | 210/755 |

OTHER PUBLICATIONS

"Baker's Yeast Production" (Chap. 6, pp. 261-313).
William D. Pandolfe, Ph.D., "Cell Disruption by Homogenization".
Donna J. Schlemm, et al. "Medicinal Yeast Extracts" Cell Stress and Chaperones (Feb. 1999, 4 (3), pp. 171-176).
J. Peter Bentley, Ph.D., et al. "Peptides From Live Yeast Cell Derivative Stimulate Wound Healing" Arch Surg (May, 1009, vol. 124, pp. 641-646).
Euan W. Low, et al. "Reducing Production of Excess Biomass During Wastewater Treatment" Wat. Res., (vol. 33, No. 5, pp. 1119-1132, 1999).
Euan W. Low, et al. "The Use of Chemical Uncouplers for Reducing Biomass Production During Biodegradation" Wat. Sci. Tech. (vol. 37, No. 4-5, pp. 399-402, 1998).
James B. Russell, et al. "Energetics of Bacterial Growth: Balance of Anabolic and Catabolic Reactions" Microbiological Reviews (Mar. 1995, pp. 48-62).

* cited by examiner

*Primary Examiner*—Lorna M Douyon
*Assistant Examiner*—Tri V Nguyen
(74) *Attorney, Agent, or Firm*—Sam K. Tahmassebi; TechLaw, LLP

(57) ABSTRACT

Surfactant-containing compositions are described which include a protein component that has the effect of improving the surface-active properties of the surfactants contained in the compositions. The surfactant-containing compositions having the protein component demonstrate significantly lower critical micelle concentrations (CMC), reduced surface tensions, and reduced interfacial tensions than do comparable compositions having no protein component. In addition, the surfactant-containing compositions having the protein component has the effect of converting greasy waste contaminants to surface active materials.

19 Claims, No Drawings

SURFACTANT COMPOSITION WITH A REDUCTION OF SURFACE TENSION, INTERFACIAL TENSION, AND CRITICAL MICELLE CONCENTRATION USING A PROTEIN-BASED SURFACTANT SYNERGIST

RELATED APPLICATION DATA

This application is a continuation in part of U.S. patent application Ser. No. 10/837,312, entitled "Improving Surface Active Properties of Surfactants," filed Apr. 29, 2004. This application also claims the benefit of U.S. Provisional Application Ser. No. 60/639,279, entitled "Reduction of Surface Tension and Interfacial Tension Using a Protein-Based Surfactant Synergist," filed Dec. 28, 2004. Each of the foregoing applications is hereby incorporated by reference in its entirety.

FIELD OF THE INVENTION

This invention relates to surfactant mixtures with improved surface-active properties, and methods of making and using the same. More particularly, this invention relates to surfactant compositions containing a low molecular weight protein component that has the effect of improving the surface-active properties of the surfactants contained in the compositions, including reducing the critical micelle concentrations, surface tensions, and interfacial tensions of the surfactants.

BACKGROUND OF THE INVENTION

Surfactants (also called surface active agents or wetting agents) are organic chemicals that reduce surface tension in water and other liquids. There are hundreds of compounds that can be used as surfactants. These compounds are usually classified by their ionic behavior in solutions: anionic, cationic, non-ionic or amphoteric (zwitterionic). Each surfactant class has its own specific physical, chemical, and performance properties.

Surfactants are compounds composed of both hydrophilic and hydrophobic or lipophilic groups. In view of their dual hydrophilic and hydrophobic nature, surfactants tend to concentrate at the interfaces of aqueous mixtures; the hydrophilic part of the surfactant orients itself towards the aqueous phase and the hydrophobic parts orients itself away from the aqueous phase into the second phase.

The hydrophobic part of a surfactant molecule is generally derived from a hydrocarbon containing 8 to 20 carbon atoms (e.g. fatty acids, paraffins, olefins, alkylbenzenes). The hydrophilic portion may either ionize in aqueous solutions (cationic, anionic) or remain un-ionized (non-ionic). Surfactants and surfactant mixtures may also be amphoteric or zwitterionic.

Surfactants are known for their use in personal care products (e.g., soaps, specialty soaps, liquid hand soaps, shampoos, conditioners, shower gels, dermatology and acne care products), household products (e.g., dry and liquid laundry detergents, dish soaps, dishwasher detergents, toilet bowl cleaners, upholstery cleaners, glass cleaners, general purpose cleaners, fabric softeners), hard surface cleaners (e.g., floor cleaners, metal cleaners, automobile and other vehicle cleaners), pet care products (e.g., shampoos), and cleaning products in general. Other uses for surfactants are found in industrial applications in lubricants, emulsion polymerization, textile processing, mining flocculates, petroleum recovery, dispersants for pigments, wetting or leveling agents in paints and printing inks, wetting agents for household and agricultural pesticides, wastewater treatment and collection systems, off-line and continuous cleaning, and manufacture of cross-flow membrane filters, such as reverse osmosis (RO), ultra filtration (UF), micro filtration (MF) and nano filtration (UF), plus membrane bioreactors (MBRs), and all types of flow-through filters including multi-media filters, and many other products and processes. Surfactants are also used as dispersants for tramp oil in cooling towers and after oil spills.

SUMMARY OF THE INVENTION

The present invention relates to the use of a protein component that is used as an additive to surfactant-containing compositions in order to improve the surface-active properties of the surfactants. In this way, the surfactant-containing compositions may be made more effective, or they may be formulated to have a lower concentration of surfactants than would otherwise be needed to achieve a desired level of surface-activity.

The protein component preferably comprises a variety of proteins produced by an aerobic yeast fermentation process. The aerobic yeast fermentation process is conducted within a reactor having aeration and agitation mechanisms, such as aeration tubes and/or mechanical agitators. The starting materials (liquid growth medium, yeast, sugars, additives) are added to the fermentation reactor and the fermentation is conducted as a batch process. After fermentation, the fermentation product may be subjected to additional procedures intended to increase the yield of proteins produced from the process. Examples of these additional procedures include heat shock of the fermentation product, physical and/or chemical disruption of the yeast cells to release additional polypeptides, lysing of the yeast cells, or other procedures and printing inks, wetting agents for household and agricultural pesticides, wastewater treatment and collection systems, off-line and continuous cleaning, and manufacture of cross-flow membrane filters, such as reverse osmosis (RO), ultra filtration (UF), micro filtration (MF) and nano filtration (UF), plus membrane bioreactors (MBRs), and all types of flow-through filters including multi-media filters, and many other products and processes. Surfactants are also used as dispersants for tramp oil in cooling towers and after oil spills.

As will be appreciated by those of ordinary skill in the art, the foregoing list of embodiments is not intended to be exclusive, as the advantages obtained by the use of the protein mixture described herein may be applied to any cleaning composition or other surfactant-containing composition.

The addition of the protein mixture of the present invention to a surfactant-containing composition has the effect of improving, increasing, and enhancing the surface-active properties of the surfactants contained in the composition by binding with the surfactants, resulting in lower critical micelle concentrations when compared to critical micelle concentrations achieved when using the surfactants alone. An additional feature of combining the low molecular weight proteins with surfactants is a reduction of the surface tension for the surfactant(s). A third feature of combining the low molecular weight proteins with surfactants is a reduction of the interfacial tension for the surfactant(s). A fourth feature of combining the low molecular weight proteins with surfactants is the increase in the amount of grease and oil that is converted to water-soluble materials. A fifth feature of combining the low molecular weight proteins with surfactants is that a portion of the solublized grease and oil, as well as other organic compounds are converted to "surfactant-like" materials. A sixth feature of combining the low molecular weight proteins with surfactants is a further enhancement of the aforementioned features when described herein and/or known to those of skill in the art. The yeast cells are removed by centrifugation or filtration to produce a supernatant containing the protein component.

The protein component produced by the above fermentation process comprises a large number of proteins having a variety of molecular weights. Although the entire composition of proteins may be useful for improving surface-active properties of surfactants, the inventors have found that the proteins having molecular weights in the range of about 100 to about 450,000 daltons, and preferably from about 500 to about 50,000 daltons, and most preferably from about 6,000 to about 17,0000 daltons (as indicated by results of polyacrylamide gel electrophoresis), are sufficient to achieve desirable results.

Although the protein component of the present invention is preferably obtained by the foregoing fermentation process, the component may also be obtained by alternative methods, including direct synthesis or isolation of the proteins from other naturally occurring sources.

The protein component may advantageously be used as an additive to cleaning compositions, which comprise a detersive surfactant system and adjunct detergent ingredients. Several (non-limiting) embodiments of cleaning compositions include personal care products (e.g., soaps, specialty soaps, liquid hand soaps, shampoos, conditioners, shower gels, dermatology and acne care products), household products (e.g., dry and liquid laundry detergents, dish soaps, dishwasher detergents, toilet bowl cleaners, upholstery cleaners, fabric softeners), hard surface cleaners (floor cleaners, metal cleaners, automobile and other vehicle cleaners), pet care products (e.g., shampoos), cleaning of fruits and vegetables of residual oils and pesticides, and cleaning products in general. Other uses for surfactants are found in industrial applications in lubricants, emulsion polymerization, textile processing, mining flocculates, petroleum recovery, dispersants for pigments, wetting or leveling agents in paints the composition is utilized under non-sterile conditions. A seventh feature of combining the low molecular weight proteins with surfactants is that the biodegradability of the resulting products is improved, reducing the time required to biodegrade the surfactants, and other organic additives included in the cleaning compositions, by up to 50%. An eighth feature of combining the low molecular weight proteins with surfactants in paints, printing inks, and other like coating products results in improved coverage and adhesion to the substrates to which they are applied. A ninth feature of combining the low molecular weight proteins with surfactants is that cleaning compositions may be formulated to have a lower concentration than would otherwise be needed to achieve a desired level of surface activity. A tenth feature of combining the low molecular weight proteins with surfactants in pesticides is that the improved wetting effect results in greater wetting or spreading of household, industrial and agricultural insecticides, and improving their efficacy. An eleventh feature of combining the low molecular weight proteins with surfactants is to improve the wetting of surfactants and other stabilization materials in the manufacture of cross-flow membrane filtration so as to maintain the integrity of the membrane pore size. A twelfth feature of combining the low molecular weight proteins with surfactants is to lower surface tension of cooling systems, allowing greater contact with the heat exchanging device and, thus, improving the efficiency of the cooling system.

These and other features and advantages of the compositions and methods described herein will be appreciated upon consideration of the detailed descriptions contained below.

DETAILED DESCRIPTIONS OF THE PREFERRED EMBODIMENTS

The compositions of the present invention include a low molecular weight protein component used in combination with a surfactant-containing composition—for example, a wetting or leveling composition—to improve, increase and enhance the surface-active properties of the surfactants contained in the composition.

Low Molecular Weight Protein Component

As used herein, the term "aerobic yeast fermentation process of the present invention" is defined as the standard propagation conditions utilized in the production of commercially available baker's yeast as described by Tilak Nagodawithana in "Baker's Yeast Production" and further described below.

As used herein, the term "Live Yeast Cell Derivative (LYCD) of the present invention" is defined as an alcoholic extract obtained from yeast prepared as described below.

As used herein, the term "low molecular weight proteins of the present invention" are defined as the biologically active polypeptide fraction comprised of a size less than 30,000 daltons, which are obtained from aerobic fermentation processes and LYCD as described herein.

As used herein, the term "surfactants of the present invention" are defined as non-ionic, anionic and cationic surfactants described below.

In a first example, the low molecular weight protein component comprises the supernatant recovered from an aerobic yeast fermentation process. Yeast fermentation processes are generally known to those of skill in the art, and are described, for example, in the chapter entitled "Baker's Yeast Production" in Nagodawithana T. W. and Reed G., Nutritional Requirements of Commercially Important Microorganisms, Esteekay Associates, Milwaukee, Wis., pp 90-112 (1998), which is hereby incorporated by reference. Briefly, the aerobic yeast fermentation process is conducted within a reactor having aeration and agitation mechanisms, such as aeration tubes and/or mechanical agitators. The starting materials (e.g., liquid growth medium, yeast, a sugar or other nutrient source such as molasses, corn syrup, or soy beans, diastatic malt, and other additives) are added to the fermentation reactor and the fermentation is conducted as a batch process.

After fermentation, the fermentation product may be subjected to additional procedures intended to increase the yield of the protein component produced from the process. Several examples of post-fermentation procedures are described in more detail below. Other processes for increasing yield of protein component from the fermentation process may be recognized by those of ordinary skill in the art.

*Saccharomyces cerevisiae* is a preferred yeast starting material, although several other yeast strains may be useful to produce yeast ferment materials used in the compositions and methods described herein. Additional yeast strains that may be used instead of or in addition to *Saccharomyces cerevisiae* include *Kluyveromyces marxianus, Kluyveromyces lactis, Candida utilis* (Torula yeast), *Zygosaccharomyces, Pichia*, Hansanula, and others known to those skilled in the art.

In the first embodiment, *saccharomyces cerevisiae* is grown under aerobic conditions familiar to those skilled in the art, using a sugar, preferably molasses or corn syrup, soy beans, or some other alternative material (generally known to one of skill in the art) as the primary nutrient source. Additional nutrients may include, but are not limited to, diastatic malt, diammonium phosphate, magnesium sulfate, ammonium sulfate zinc sulfate, and ammonia. The yeast is preferably propagated under continuous aeration and agitation between 30 degrees to 35 degrees C. and at a pH of 5.2 to 5.6. The process takes between 10 and 25 hours and ends when the fermentation broth contains between 4 and 8% dry yeast solids, (alternative fermentation procedures may yield up to 15-16% yeast solids), which are then subjected to low food-to-mass stress conditions for 2 to 24 hours. Afterward, the yeast fermentation product is centrifuged to remove the cells, cell walls, and cell fragments. It is worth noting that the yeast cells, cell walls, and cell fragments will also contain a number of useful proteins suitable for inclusion in the protein component described herein.

In an alternative embodiment, the yeast fermentation process is allowed to proceed until the desired level of yeast has been produced. Prior to centrifugation, the yeast in the fermentation product is subjected to heat-stress conditions by increasing the heat to between 40 and 60 degrees C., for 2 to 24 hours, followed by cooling to less than 25 degrees C. The yeast fermentation product is then centrifuged to remove the yeast cell debris and the supernatant, which contains the protein component, is recovered.

In a further alternative embodiment, the fermentation process is allowed to proceed until the desired level of yeast has been produced. Prior to centrifugation, the yeast in the fermentation product is subjected to physical disruption of the yeast cell walls through the use of a French Press, ball mill, high-pressure homogenization, or other mechanical or chemical means familiar to those skilled in the art, to aid the release of intracellular, polypeptides and other intracellular materials. It is preferable to conduct the cell disruption process following a heat shock, pH shock, or autolysis stage. The fermentation product is then centrifuged to remove the yeast cell debris and the supernatant is recovered.

In a still further alternative embodiment, the fermentation process is allowed to proceed until the desired level of yeast has been produced. Following the fermentation process, the yeast cells are separated out by centrifugation. The yeast cells are then partially lysed by adding 2.5% to 10% of a surfactant to the separated yeast cell suspension (10%-20% solids). In order to diminish the protease activity in the yeast cells, 1 mM EDTA is added to the mixture. The cell suspension and surfactants are gently agitated at a temperature of about 25° to about 35° C. for approximately one hour to cause partial lysis of the yeast cells. Cell lysis leads to an increased release of intracellular proteins and other intracellular materials. After the partial lysis, the partially lysed cell suspension is blended back into the ferment and cellular solids are again removed by centrifugation. The supernatant, containing the protein component, is then recovered.

In a still further alternative embodiment, fresh live *Saccharomyces cerevisiae* is added to a jacketed reaction vessel containing methanol-denatured alcohol. The mixture is gently agitated and heated for two hours at 60 degrees C. The hot slurry is filtered and the filtrate is treated with charcoal and stirred for 1 hour at ambient temperature, and filtered. The alcohol is removed under vacuum and the filtrate is further concentrated to yield an aqueous solution containing the protein component. This LYCD composition is then preferably blended with water, surfactants and stabilizing agents and the pH adjusted to between 4.0 and 4.6 for long-term stability.

In a still further embodiment, the heat shock process in the preceding embodiment includes several stages of agitating and heating, cooling and repeating the cycle, in order to increase the output of the low molecular weight protein component.

In a still further alternative embodiment, the protein component is further refined so as to isolate the proteins having a molecular weight of between about 100 and about 450,000, and preferably between about 500 and about 30,000 daltons, utilizing Anion Exchange Chromatography of the fermentation supernatant, followed by Molecular Sieve Chromatography. The refined protein component is then blended with water, surfactants and stabilizing agents and the pH of the composition is then adjusted to between 4.0 and 4.6 to provide long-term stability to the compositions.

In a still further alternative embodiment, preservatives and stabilizers are added to the protein component compositions and the pH is adjusted to between 4.0 and 4.6 to provide long-term stability to the compositions.

The foregoing descriptions provide examples of a low molecular weight protein component suitable for use in the compositions and methods described herein. These examples are not exclusive. For example, those of skill in the art will recognize that the protein component may be obtained by isolating suitable proteins from an alternative protein source, by synthesis of proteins, or by other suitable methods. The foregoing description is not intended to limit the term "low molecular weight protein component" only to those examples included herein.

Additional details concerning the fermentation processes and other aspects of the protein component are described in U.S. patent application Ser. No. 10/799,529, filed Mar. 11, 2004 now U.S. Pat. No. 7,476,529, entitled "Altering Metabolism in Biological Processes," which is assigned to the assignee of the present application. Still further details concerning these processes and materials are described in U.S. patent application Ser. No. 09/948,457, filed Sep. 7, 2001 now U.S. Pat. No. 6,699,391, entitled "Biofilm Reduction in Crossflow Filtration Systems," which is also assigned to the assignee of the present application. Each of these United States patent applications is hereby incorporated by reference herein in its entirety.

Surfactants

The compositions described herein include one or more surfactants at a wide range of concentration levels. Some examples of surfactants that are suitable for use in the compositions described herein include the following:

Anionic: Sodium linear alkylbenzene sulfonate (LABS); sodium lauryl sulfate; sodium lauryl ether sulfates; petroleum sulfonates; linosulfonates; naphthalene sulfonates, branched alkylbenzene sulfonates; linear alkylbenzene sulfonates; fatty acid alkylolamide sulfosuccinate; alcohol sulfates; dioctyl ester of sodium sulfosuccinic acid.

Cationic: Stearalkonium chloride; benzalkonium chloride; quaternary ammonium compounds; amine compounds; ethosulfate compounds.

Non-ionic: Dodecyl dimethylamine oxide; coco diethanolamide alcohol ethoxylates; linear primary alcohol polyethoxylate; alkylphenol ethoxylates; alcohol ethoxylates; EO/PO polyol block polymers; polyethylene glycol esters; fatty acid alkanolamides.

Amphoteric: Cocoamphocarboxyglycinate; cocamidopropylbetaine; betaines; imidazolines.

In addition to those listed above, suitable nonionic surfactants include alkanolamides, amine oxides, block polymers, ethoxylated primary and secondary alcohols, ethoxylated alkylphenols, ethoxylated fatty esters, sorbitan derivatives, glycerol esters, propoxylated and ethoxylated fatty acids, alcohols, and alkyl phenols, alkyl glucoside glycol esters, polymeric polysaccharides, sulfates and sulfonates of ethoxylated alkylphenols, silicone glycol copolymers, polymeric surfactants, and Gemini surfactants that have two hydrophilic heads connected to two or three hydrophobic tails. Suitable anionic surfactants include ethoxylated amines and/or amides, sulfosuccinates and derivatives, sulfates of ethoxylated alcohols, sulfates of alcohols, sulfonates and sulfonic acid derivatives, phosphate esters, and polymeric surfactants. Suitable amphoteric surfactants include betaine derivatives. Suitable cationic surfactants include amine surfactants, quaternary ammonium chloride surfactants, ethyldimonium ethosulfates, and other quaternary surfactants. Those skilled in the art will recognize that other and further surfactants are potentially useful in the compositions depending on the particular detergent application.

Preferred anionic surfactants used in some detergent compositions include CalFoam™ ES 603, a sodium alcohol ether sulfate surfactant manufactured by Pilot Chemicals Co., Steol™ CS 460, a sodium salt of an alkyl ether sulfate manufactured by Stepan Company, and Aerosol OT™, a dioctyl ester of sodium sulfosuccinic acid manufactured by Cytec Industries, Inc. Preferred nonionic surfactants include Neodol™ 25-7 or Neodol™ 25-9, which are C12-C15 linear primary alcohol ethoxylates manufactured by Shell Chemical Co., and Genapol™ 26 L-60, which is a C12-C16 natural linear alcohol ethoxylated to 60E C cloud point (approx. 7.3 mol), manufactured by Hoechst Celanese Corp.

Several of the known surfactants are non-petroleum based. For example, several surfactants are derived from naturally occurring sources, such as vegetable sources (coconuts, palm, castor beans, etc.). These naturally derived surfactants may offer additional benefits such as biodegradability.

It should be understood that these surfactants and the surfactant classes described above are identified only as preferred materials and that this list is neither exclusive nor limiting of the compositions and methods described herein.

Surface and Interfacial Tension Reducing Compositions

The surface and interfacial tension reducing compositions described herein generally comprise a surfactant system and adjunct surfactant ingredients. As those of skill in the art will recognize, the formulation of a given composition for reducing surface and/or interfacial tension will depend upon its intended use. An example of such use include surfactants used to improve the dispersing of pigments, or enhance the wetting or spreading of coating materials such as printing inks, paints, and other coatings where improved appearance and adhesion are desired. Yet another example of such use includes the use of surfactants in household, industrial and agricultural pesticides where improved contact of the pesticide through lower surface and interfacial tension would enhance the efficacy of said pesticides. A further example of such use includes the use of surfactants in conjunction with (or in place of) glycerine for the stabilization of reverse osmosis, micro, ultra and nano cross-flow membrane filtration systems where better penetration of the membrane will yield greater stabilization of the integrity of the pore size. Another example of such use includes the use of surfactants in cooling systems where reduction of interfacial and surface tension would improve the contact of the cooling agent in the heat exchanger, thus improving the efficiency of the cooling system. Other uses are in industrial applications in lubricants, emulsion polymerization, improving the passage of fluids through the upper woven layer of diapers, mining flocculates, petroleum recovery, wastewater treatment and collection systems, improve settling or separation in clarifiers or dissolved air flotation systems, and many other products and processes. Surfactants are also used as dispersants for tramp oil in cooling towers and after oil spills, use in flume water or for cleaning of fruits and vegetables in food processing plants, off-line and continuous feed cleaning of cross-flow membranes, such as RO, UF, MF and NF, plus membrane bioreactors, and all types of flow through filters, including multi-media filters.

Cleaning and Degreasing Compositions

The cleaning and degreasing compositions described herein generally comprise a detersive surfactant system and adjunct detergent ingredients. As those of skill in the art will recognize, the formulation of a given cleaning composition will depend upon its intended use. Examples of such uses include personal care products (e.g., soaps, specialty soaps, liquid hand soaps, shampoos, conditioners, shower gels, dermatology and acne care products), household products (e.g., dry and liquid laundry detergents, dish soaps, dishwasher detergents, toilet bowl cleaners, upholstery cleaners, glass cleaners, general purpose cleaners, fabric softeners), hard surface cleaners (e.g., floor cleaners, metal cleaners, automobile and other vehicle cleaners), pet care products (e.g., shampoos), cleaning fruits and vegetables of residual oils and pesticides, and cleaning products in general. Other uses are in industrial applications in lubricants, emulsion polymerization, textile processing, mining flocculates, petroleum recovery, wastewater treatment and collection systems, and many other products and processes. Surfactants are also used as dispersants for tramp oil in cooling towers and after oil spills, use in flume water or for cleaning of fruits and vegetables in food processing plants, off-line and continuous feed cleaning of cross-flow membranes, such as RO, UF, MF and NF, plus membrane bioreactors, and all types of flow through filters, including multi-media filters.

The detersive surfactant system may include any one or combination of the surfactant classes and individual surfactants described in the previous section and elsewhere herein, or other surfactant classes and individual surfactants known to those of skill in the art. For example, a typical liquid laundry detergent will include a combination of anionic and nonionic surfactants as the detersive surfactant system. Nonionic surfactants generally give good detergency on oily soil, whereas anionic surfactants generally give good detergency on particulate soils and contribute to formulation stability.

Adjunct detergent ingredients may include any of a range of additives that are advantageous for obtaining a desired beneficial property. For example, a typical liquid laundry detergent will include neutralizers such as monoethanolamine (MEA), diethanolamine (DEA), or triethanolamine (TEA); hydrotropic agents such as ethanol; enzyme stabilizers such as propylene glycol and/or borax; and other additives. Laundry detergents, as well as cleaning and degreasing composition formulae, are generally known to those skilled in the art. As used herein, the term "conventional detergent" or "conventional cleaners and degreasers" refers to compositions currently available either commercially or by way of formulations available from the literature. Examples include "conventional liquid laundry detergents," "conventional hand soaps," and others of the "conventional" cleaning compositions described herein.

Effect on Critical Micelle Concentration

A number of experiments were performed in which it was observed that the combination of the protein component with a surfactant-containing composition caused a downward shift in the critical micelle concentration (CMC) relative to that of the surfactant-containing composition without the protein component. CMC is the characteristic concentration of surface active agents (surfactants) in solution above which the appearance and development of micelles brings about sudden variation in the relation between the concentration and certain physico-chemical properties of the solution (such as the surface tension). Above the CMC the concentration of singly dispersed surfactant molecules is virtually constant and the surfactant is at essentially its optimum of activity for many applications.

The table below shows the results of CMC measurements on a sample containing surfactant alone (Sample A), and two samples containing surfactant and a protein component (Samples B and C). All tests were conducted in duplicate, by standard surface tension as a function of concentration experimentation using a Kruss Processor Tensiometer K12 with an attached automated dosing accessory. For each test a high concentration stock solution was incrementally dosed into pure distilled water, whilst measuring surface tension at each successive concentration.

Critical Micelle Concentration Values for Samples in Pure Distilled Water (on a ppm of sample basis)

| Sample | Test # | CMC (ppm) |
|---|---|---|
| Sample A (Surfactant without protein component) | Test 1 | 443 |
| | Test 2 | 440 |
| | Average | 442 |
| Sample B (Surfactant with protein component) | Test 1 | 74.6 |
| | Test 2 | 75.3 |
| | Average | 75.0 |
| Sample C (Surfactant with protein component) | Test 1 | 59.8 |
| | Test 2 | 60.1 |
| | Average | 60.0 |

Samples B and C, containing the protein component, show reductions in CMC values of 83% and 86.4% respectively over the values observed for Sample A, the surfactant composition without the protein component.

The compositions utilized in the above samples were the following:

| Component | Concentration (% by weight) Sample A | Samples B & C |
|---|---|---|
| Water | 84.92 | 64.92 |
| Protein Component (Samples B and C only) (Product of fermentation of *saccharomyces cerevisiae*, without additional processing) | 0 | 20.0 |
| Inorganic salts (e.g., diammonium phosphate, ammonium sulfate, magnesium sulfate, zinc sulfate, calcium chloride) | 0.31 | 0.31 |
| Neodol ™ 25-7 (Non-ionic surfactant) | 7.5 | 7.5 |
| Steol ™ CS 460 (Anionic surfactant) | 1.5 | 1.5 |
| Propylene glycol | 5.27 | 5.27 |
| Methyl paraben | 0.15 | 0.15 |
| Propyl paraben | 0.05 | 0.05 |
| Sodium benzoate | 0.15 | 0.15 |
| BHA | 0.02 | 0.02 |
| BHT | 0.02 | 0.02 |
| Ascorbic acid | 0.11 | 0.11 |
| | 100.00 | 100.00 |

As the foregoing results demonstrated, the addition of the protein component to Samples B and C caused up to a seven-fold downward shift in the CMC value for the surfactant-containing composition. In effect, the protein component increases the surface-active properties of the surfactants contained in the composition.

The downward shift in CMC value obtained by incorporating the protein component in a surfactant-containing composition has substantial utility for use in detergent compositions such as those described herein. In particular, the downward shift of CMC value for a given detersive surfactant or surfactant package in the presence of the protein component means that the surfactant(s) demonstrate an improved, increased, or enhanced level of surface-active properties. Thus, for a given detergent composition, the incorporation of the protein component in the composition makes it possible to obtain a greater level of surface-activity from the surfactants contained in the composition than would be obtained from the unmodified detergent composition. Alternatively, it would be possible to reduce the level of surfactant(s) contained in the detergent composition without sacrificing the level of surface-activity of the composition, or its cleaning ability.

For example, a conventional premium liquid laundry detergent formulation includes about 25% to about 40% by weight of surfactants. One such formulation, having 36% surfactants by weight, is reproduced below:

Premium Liquid Laundry Detergent Formulation

| Ingredients | % Wt | Function | Trade Name |
|---|---|---|---|
| Water | 53.36 | | |
| Boric acid | 1.10 | Enzyme stabilizer | |
| Sodium gluconate | 0.70 | Enzyme stabilizer | |
| Propylene glycol | 3.00 | Enzyme stabilizer | |
| EtOH 3A | 3.00 | Hydrotrope | |
| AG (50%) | 5.80 | Surfactant | Glucopon 625 UP |
| AE | 5.20 | Surfactant | Neodol 25-7 |
| FAES | 25.00 | Surfactant | Texapon N-70 |
| Optical brightener | 0.14 | UV whitening agent | |
| Sodium hydroxide, 50% | 0.50 | Neutralizer | |
| Monoethanolamine | 0.50 | Buffer | |
| Protease | 0.75 | Enzyme | Savinase 16.0L |
| Amylase | 0.95 | Enzyme | Termylase 300L |
| Preservative/optical brightener | as needed | | |

(T. Morris, S. Gross, M. Hansberry, "Formulating Liquid Detergents for Multiple Enzyme Stability," Happi, January 2004, pp. 92-98). By incorporating the protein component described herein in a formulation such as the liquid laundry detergent listed above, it is possible to reduce the surfactant levels by at least 40%, and up to about 75% or more, while retaining a comparable CMC value for the laundry detergent composition and without sacrificing the cleaning performance of the formulation. Similar results may be obtained by incorporating the protein component in other detergent compositions, including all of those described elsewhere herein.

Thus, in addition to the compositions described herein, there are also described methods for improving, enhancing, and/or increasing the surface-active properties of surfactants in surfactant-containing compositions, and methods for reducing the levels of surfactants required for surfactant-containing compositions such as the detergent compositions described herein. In all of these methods, the beneficial results are obtained by the inclusion of a suitable protein component in the detergent composition. The resulting compositions will have CMC values and cleaning efficiency that are comparable to, or better than, the unmodified compositions.

Conversion of Grease to Surface-Active Material

Experiments were performed in which it was observed that the protein component, when used in combination with one or more surfactants, had the effect of converting greasy waste contaminants to surface active materials. In the experiments, a composition including surfactants and a protein component was added to diluted waste activated sludge (WAS), followed by observation of the volume of a bacon grease droplet in the composition. Interfacial tension reduction was confirmed to be by the creation of surfactant-like (interfacially active) materials, by checking the critical micelle concentration of the retains and noting that the critical micelle concentration was, in fact, reduced after exposure of the solution to the bacon grease.

In the following experiments, a small droplet of grease was formed on the end of a capillary tip within a bulk phase of the sample aqueous solution being studied. Measurements of interfacial tension between the droplet and the aqueous phase and of droplet volume were made as a function of elapsed time by optical pendant drop interfacial analysis using a Kruss Drop Shape Analysis System.

Trial 1: Grease Droplet in Aqueous Solutions

In a first experiment, a 5.0 microliter droplet of bacon grease was placed in a 5.0 milliliter aqueous solution and allowed to reach equilibriums for interfacial tension and droplet volume. In a first case, the aqueous solution was pure water. In a second, the aqueous solution contained 10 ppm of the Sample A formulation (surfactant-containing composition with no protein component). In a third, the aqueous solution contained 10 ppm of the Sample B formulation (surfactant-containing composition with protein component). These studies were conducted under static conditions; that is, no agitation of the aqueous solution was utilized. The results are as follows.

Effect of Aqueous Solutions at 5.0 ml on a 5.0 microliter Bacon Grease Droplet

| Aqueous Solution | Initial Interfacial Tension with Bacon Grease (mN/m) | Equilibrium Interfacial Tension with Bacon Grease (mN/m) | Time Elapsed for Intervacial Tension Equilibration (minutes) | Equilibrium Grease Drop Volume (ul) | Time Elapsed for Volume Equilibration (minutes) |
|---|---|---|---|---|---|
| Sample B (10 ppm) | 15.80 | 7.06 | 1300 | 4.44 | 1300 |
| Sample A (10 ppm) | 18.20 | 17.35 | 30 | 4.92 | 500 |
| Pure water | 25.34 | 25.32 | NA | 5.00 | NA |

Effect of 5.0 microliter Bacon Grease Droplet on 5.0 ml Aqueous Solutions

| Aqueous Solution | Initial Surface Tension (mN/m) | Surface Tension After Grease Exposure (mN/m) | CMC No Grease Exposure (ppm) | CMC Found Starting with Grease Exposed Retain (ppm) |
|---|---|---|---|---|
| Sample B (10 ppm) | 64.12 | 39.01 | 75 | 35 |
| Sample A (10 ppm) | 71.60 | 71.57 | 442 | 442 |
| Pure Water | 72.50 | 72.48 | NA | NA |

Several conclusions were drawn from the above data. First, it was noted that pure water had no effect on the bacon grease, nor did the bacon grease have any effect on the pure water.

An additional conclusion drawn from the above data was that, with the surfactant package alone (Sample A, without the protein component), about 1.6% of the bacon grease volume (0.08 ul of 5.0 ul) is lost into the aqueous phase. However, it was concluded that this effect was due to emulsification of hydrophobic grease by the surfactants involved, and that it did not result in any significant increase in the amount of surfactant-like material available in the aqueous phase. This conclusion was based on three of the parameters listed above. First, the surface tension of the retain, after bacon grease exposure, was not significantly lower than the surface tension of the same aqueous solution before bacon grease exposure (as it would be if surface-active materials were added to the aqueous phase). Second, the CMC for the additives in the aqueous phase was unaffected by bacon grease exposure (it would be expected to decrease if significant amounts of new surface-active materials were created due to exposure to the grease). Third, the interfacial tension decay of the surfactant-only sample (Sample A) lasted about 30 minutes, whereas the loss of grease droplet volume in the Sample A solution lasted about 500 minutes, during which time the interfacial tension was already equilibrated. If the grease volume going into the aqueous phase was providing extra soluble surfactants to the aqueous phase, the interfacial tension would have been expected to continue to decay during the loss of grease droplet volume. This would be expected unless the interface between the grease droplet and the water was saturated with surfactant, so that added soluble surfactant to the aqueous phase could not go to that interface. However, at an interfacial tension of 17.35 mN/m, it is not possible that the interface was saturated with surfactant. Therefore, the emulsification of hydrophobic grease is the only reasonable explanation for the 1.6% grease lost in the Sample A data above.

Yet another conclusion drawn from the above data is that, in the Sample B case, which includes a surfactant-containing composition including a protein component, the much longer term and more substantial interfacial tension and grease droplet volume decay suggest that new interfacial active species are being generated by breakdown of the grease. This is shown by the following analysis.

First, the surface tension of post grease exposure is greatly reduced compared to pre-grease exposure. Second, the time to reach equilibrium is much greater than the 30 minutes that is typical for two immiscible liquids. The data indicate that the reaction of the conversion of grease had ceased after about 1300 minutes without the interface between the grease and the solution being saturated, which would happen at a lower interfacial tension. The interfacial tension decay ceased at about 7.06 mN/m. The fact that the curves for the decrease in surface tension and the CMC are nearly identical, suggests that there is a secondary reaction taking place to breakdown the grease. That secondary reaction is the addition of surfactant-like by-products caused by the breakdown of the grease droplet. Third, the grease droplet reduction of 11% is much greater than the 1.6% reduction observed with the surfactant package alone. Finally, the control, using pure water, showed that the water component has no effect on the grease.

The results can be quantified as follows:

A mass balance was performed and the findings analyzed. It was observed that 0.56 ul of the grease (11.2% of the original grease droplet volume) passed into the 5.0 ml aqueous solution containing 10 ppm of Sample B after 24 hours. This represents an 112 ppm concentration of former grease materials in the aqueous phase. The CMC of the aqueous phase, post-grease exposure, was observed to be 35 ppm, as compared to 75 ppm for the aqueous Sample B composition prior to grease exposure. Thus, the CMC decreased by 40 ppm due to the presence of 112 ppm of former grease materials being converted into the water phase. Stated in other terms, 40/112, or 35.7% of the grease droplet materials lost from the grease droplet became surfactant-like, interfacially active species in the aqueous phase, with the cleaning power of the order of the cleaning power of the Sample B formulation. We can calculate that, with a grease droplet volume reduction of 11.2%, with 35.7% being surfactant-like by-products, 4% of the grease droplet is being converted into materials capable of cleaning more grease. This compares to 0% conversion when using either pure water, or as in the case of the surfactant package only (Sample A).

Trial 2: Grease Droplet in Waste Activated Sludge

In a second experiment, a 5.0 microliter droplet of bacon grease was placed in a 5.0 milliliter in a 1:10 diluted aqueous mixture of waste activated sludge (WAS) and allowed to reach equilibriums for interfacial tension and droplet volume. In a first case, the aqueous solution contained only WAS. In a second, the aqueous solution also contained 10 ppm of the Sample B formulation (surfactant-containing composition with protein component). The results are as follows.

Again, several conclusions were drawn from the above data. First, in both systems, it is apparent that grease is converted to interfacially active materials. However, the conversion of grease to interfacially active materials was much more substantial with the 10 ppm of Sample B present in the diluted WAS, relative to the diluted WAS alone. Further, the conversion of grease to interfacially active materials by the Sample B formulation was much more substantial in the diluted WAS than it was in pure water. Still further, sufficient grease conversion takes place in the Sample B case to saturate the aqueous phase/grease droplet interface, at an interfacial tension of about 3.50 mN/m, while the conversion reaction continued to add more interfacially active species to the bulk of the 10 ppm Sample B phase.

Turning to the data, the diluted WAS was found to have a surface tension of 66.81 mN/m, before exposure to the bacon grease, which is below that of pure water (72.5 mN/m). This indicated that the diluted WAS contained some surface active species on its own. Those surface active species were also found to be interfacially active—e.g., the initial interfacial tension between the diluted WAS and the bacon grease was found to be 23.20 mN/m, below that of the interfacial tension between pure water and bacon grease (25.34 mN/m).

Duplicate 48 hour interfacial tension experiments were run with the diluted WAS against 5.0 ul grease drops, using 5.0 ml of diluted WAS for each experiment. Interfacial tension decay was observed in both trials, as compared to a complete absence of interfacial decay observed in the pure water case. The decay was from 23.50 mN/m to 20.12 mN/m. In addition, loss of grease volumes was observed, from 5.0 ul to 4.79 ul. Accordingly, about 4.2% of the grease was lost to the aqueous phase, making the converted grease material concentration in the aqueous phase about 42 ppm, at 2880 minutes. The time frame for equilibration was roughly the same for both interfacial tension and for volume decay. Also, the equilibration times were too long to be caused by simple pre-existing surfactant equilibration at the interface. Thus, it was presumed that a reaction mechanism was at work, and that creation of interfacially active species from the grease was occurring.

Effect of Aqueous Solutions at 5.0 ml on a 5.0 microliter Bacon Grease Droplet

| Diluted 1:10 WAS Aqueous Solution | Initial Interfacial Tension with Bacon Grease (mN/m) | Equilibrium Interfacial Tension with Bacon Grease (mN/m) | Time Elapsed for Intervacial Tension Equilibration (minutes) | Equilibrium Grease Drop Volume (ul) | Time Elapsed for Volume Equilibration (minutes) |
|---|---|---|---|---|---|
| Diluted WAS | 23.20 | 20.12 | g.t. 2880 | 4.79 | g.t. 2880 |
| Sample B (10 ppm) | 14.50 | 3.50 | 2500 | 3.57 | g.t. 2880 |

Effect of 5.0 microliter Bacon Grease Droplet on 5.0 ml Aqueous Solutions

| Diluted 1:10 WAS Aqueous Solution | Initial Surface Tension (mN/m) | Surface Tension After Grease Exposure (mN/m) | CMC No Grease Exposure (ppm) | CMC Found Starting with Grease Exposed Retain (ppm) |
|---|---|---|---|---|
| Diluted WAS | 66.81 | 57.07 | NA | NA |
| Sample B (10 ppm) | 60.13 | 25.72 | 68 | 4 |

The retains contained additional interfacially active material. Thus, the WAS itself was converting grease to interfacially active material. This is apparent not only from the time dependent data above, but also from the fact that the retains show surface tensions which average 57.07 mN/m—down from 66.81 mN/m before grease exposure. It was presumed, however, that insufficient amounts of interfacially active material were created to determine a CMC value for those materials alone.

Turning to the Sample B trials, the interfacial tension decay was from an initial value of 14.50 mN/m—a value lower than the initial interfacial tension for 10 ppm of Sample B in pure water, due to the interfacially active materials initially present in the WAS—to an equilibrium value of 3.5 mN/m in 2500 minutes. The fact that the grease volume loss continued out beyond the 2880 minute elapsed time period was due to the interface becoming saturated with the interfacially active materials formed in the 2500 minute time frame. As further support for this conclusion, after 48 hours of grease exposure the surface tension for the retain solutions were 25.72 mN/m. This is such a low surface tension that the solution was cleraly beyond its CMC. Thus, at that point, one would expect the grease drop interface to be saturated with interfacially active materials.

The initial surface tension for the 10 ppm Sample B formulation in diluted WAS was 60.13 mN/m, which was lower than the value in pure water (64.12 mN/m, as above). This was due to the interfacially active materials initially present in the WAS. The 25.72 mN/m average retain surface tension was, however, much lower than the 39.01 mN/m average retain surface tension from the pure water trials.

The 10 ppm Sample B retains contained so much surfactant added to it from the grease breakdown that its concentration was above the CMC. Therefore, the retains CMC determination was made by diluting the retains with WAS. The results indicated a CMC of only 4 ppm in the presence of the surfactant-materials created from the breakdown of the grease. This value may be compared to the CMC for the 10 ppm Sample B formula in WAS with no grease exposure—68 ppm.

Thus, a mass balance was performed based upon the grease volume lost. The volume decrease from the grease droplet was 1.43 ul (5.0 ul minus 3.57 ul) in 2880 minutes, which grease volume was added to the WAS phase retains. This amounted to 28.6% of the grease, or 286 ppm. The CMC decrease, relative to the 10 ppm Sample B formulation, was 68−4=64 ppm. Stated otherwise, the CMC decreased by 64 ppm due to 286 ppm of the former grease materials being taken into the WAS phase. Thus, $^{64}/_{286}$, or 22.4% of the 28.6% of the grease drop materials lost from the grease droplet become surfactant-like, interfacially active species, with the cleaning power of the order of the cleaning power of the Sample B formulation.

This calculates as 6.4% of the grease being made into materials capable of cleaning more grease (interfacially active species), for a 28.6% loss in the overall grease volume, for 10 ppm of the Sample B formulation in diluted WAS. These values are properly compared to 4.0% of the grease being made into interfacially active species for an 11.2% loss of overall grease volume for the 10 ppm of Sample B formulation in pure water. The diluted WAS alone showed a 4.2% loss of overall grease volume, with an undetermined amount of interfacially active species created. Pure water caused no grease loss (0%), and no interfacially active species development. The surfactant package alone (Sample A), caused a 1.6% grease loss, but no development of interfacially active materials.

The values for decrease in grease volume (i.e., % of a 5.0 ul drop lost due to exposure to 5 ml of the "cleaning" solution) are significant in terms of grease removal. In addition, the values for conversion of the grease into interfacially active materials capable of emulsifying grease are also significant, as they represent an autocatalytic grease removal process. These values are presented in the table below.

Effect of Various Solutions at 5.0 ml on a 5.0 ul Grease Drop

| Aqueous Solution | Grease Lost to Aqueous Phase | Grease Converted to Interfacially Active Materials |
|---|---|---|
| Pure Water | 0% | 0% |
| Sample A (10 ppm) in Pure Water | 1.5% | 0% |
| Sample B (10 ppm) in Pure Water | 11.2% | 4.0% |
| Diluted (1:10) WAS | 4.2% | NA |
| Sample B (10 ppm) in Diluted (1:10) WAS | 28.6% | 6.4% |

Effects of Low Molecular Weight Proteins

A feature of this invention is that low molecular weight proteins are a primary factor in the effects observed on surfactants. The following experiments demonstrate that removal of the larger (greater than 30,000 daltons) proteins from the compositions does not significantly reduce the benefits observed versus utilizing the full protein yield from the fermentation process as the protein component. The following study was conducted in the same manner as the above "Grease Droplet in Waste Activated Sludge" test.

Effect of Aqueous Solutions at 5.0 ml on a 5.0 microliter Bacon Grease Droplet

| Diluted 1:10 WAS Aqueous Solution | Initial Interfacial Tension with Bacon Grease (mN/m) | Equilibrium Interfacial Tension with Bacon Grease (mN/m) | Time Elapsed for Interfacial Tension Equilibration (minutes) | Equilibrium Grease Droplet Volume (ul) | Time Elapsed for Volume Equilibration (minutes) |
|---|---|---|---|---|---|
| Sample B (10 ppm) | 14.50 | 3.50 | 2000 | 3.57 | >2880 |
| Sample D (10 ppm) | 14.90 | 3.50 | 2500 | 3.78 | >2880 |

Effect of 5.0 microliter Bacon Grease Droplet on 5.0 ml Aqueous Solutions

| Diluted 1:10 WAS Aqueous Solution | Initial Surface Tension (mN/m) | Surface Tension After Grease Exposure (mN/m) | CMC - No Grease Exposure (ppm) | Retain CMC after Grease Droplet Exposure (ppm) |
|---|---|---|---|---|
| Sample B (10 ppm) | 60.13 | 25.72 | 68 | 4 |
| Sample D (10 ppm) | 60.87 | 26.43 | 70 | 9 |

These studies demonstrate little differences are observed when the larger (>30,000 dalton) materials are removed from the protein component. Initial and equilibrium interfacial tension determinations are virtually unchanged when the large molecular weight proteins are removed. When only the isolated, low molecular weight protein fraction is used, performance declined by only 5.6%, as measured by equilibrium grease droplet volume reduction. Both initial and post grease exposure surface tension data increased by only 1.2% and 2.7% respectively. The slight loss of efficacy could be attributed to a hold-back of some of the small proteins during the separation process. Further, the CMC values for post grease exposure represents a 50-fold decline over the values observed for the surfactant component (Sample A) previously tested.

A mass balance was performed based upon the grease volume lost for Sample D. The volume decrease of the grease droplet was 1.22 ul (5.0 ul minus 3.78 ul) and was added to the WAS phase retains. This amounted to 24.4% of the grease, or 244 ppm. The CMC decrease, relative to the 10 ppm Sample B formulation, was 70−9=61 ppm. Stated otherwise, the CMC decreased by 61 ppm due to 244 ppm of the former grease materials being taken into the WAS phase. Thus, 61/244, or 25.0% of the 24.4% of the grease droplet materials lost from the grease droplet become surfactant-like, interfacially active species, with the cleaning power of the order of the cleaning power of the Sample D formulation. These results demonstrate that the larger proteins (>30,000 daltons) contribute very little to the observed increase in the surfactant's efficacy when compared to Sample B, which contains the larger (>30,000 dalton) proteins.

The compositions tested are as follows:

| Component | Concentration (% by weight) | |
|---|---|---|
| | Sample B | Samples D |
| Water | 64.92 | 64.92 |
| Protein Component (Sample B only) (Product of fermentation of *saccharomyces cerevisiae*, U.S. patent application Ser. No. 10/799,529) | 20.0 | 0 |
| Protein Component (Sample D) processed through a 30,000 dalton molecular weight cutoff membrane | 0 | 20.0 |
| Inorganic salts (e.g., diammonium phosphate, ammonium sulfate, magnesium sulfate, zinc sulfate, calcium chloride) | 0.31 | 0.31 |
| Neodol ™ 25-7 (Non-ionic surfactant) | 7.5 | 7.5 |

-continued

| Component | Concentration (% by weight) | |
|---|---|---|
| | Sample B | Samples D |
| Steol ™ CS 460 (Anionic surfactant) | 1.5 | 1.5 |
| Propylene glycol | 5.27 | 5.27 |
| Methyl paraben | 0.15 | 0.15 |
| Propyl paraben | 0.05 | 0.05 |
| Sodium benzoate | 0.15 | 0.15 |
| BHA | 0.02 | 0.02 |
| BHT | 0.02 | 0.02 |
| Ascorbic acid | 0.11 | 0.11 |
| Total | 100.00 | 100.00 |

Effects on Nonionic Surfactants Versus Nonionic and Anionic Blends with Protein Components These studies were conducted to determine the effects of utilizing a nonionic surfactant alone versus blending the nonionic with anionic surfactants. The compositions tested in this study are as follows:

| Component | Concentration (% by weight) | |
|---|---|---|
| | Sample B | Samples E |
| Water | 64.92 | 66.42 |
| Protein Component (Sample B only) (Product of fermentation of *saccharomyces cerevisiae*, U.S. patent application Ser. No. 10/799,529) | 20.0 | 20.0 |
| Inorganic salt (e.g., diammonium phosphate, ammonium sulfate, magnesium sulfate, zinc sulfate, calcium chloride) | 0.31 | 0.31 |
| Neodol ™ 25-7 (Non-ionic surfactant) | 7.5 | 7.5 |
| Steol ™ CS 460 (Anionic surfactant) | 1.5 | 0 |
| Propylene glycol | 5.27 | 5.27 |
| Methyl paraben | 0.15 | 0.15 |
| Propyl paraben | 0.05 | 0.05 |
| Sodium benzoate | 0.15 | 0.15 |
| BHA | 0.02 | 0.02 |
| BHT | 0.02 | 0.02 |
| Ascorbic acid | 0.11 | 0.11 |
| Total | 100.00 | 100.00 |

Test results for the above compositions are as follows:

Effect of Aqueous Solutions at 5.0 ml on a 5.0 microliter Bacon Grease Droplet

| Diluted 1:10 WAS Aqueous Solution | Initial Interfacial Tension with Bacon Grease (mN/m) | Equilibrium Interfacial Tension with Bacon Grease (mN/m) | Time Elapsed for Interfacial Tension Equilibration (minutes) | Equilibrium Grease Droplet Volume (ul) | Time Elapsed for Volume Equilibration (minutes) |
|---|---|---|---|---|---|
| Sample B (10 ppm) | 14.50 | 3.50 | 2000 | 3.57 | >2880 |
| Sample E (10 ppm) | 23.47 | 6.18 | >2880 | 3.88 | >2880 |

| Effect of 5.0 microliter Bacon Grease Droplet on 5.0 ml Aqueous Solutions | | | | |
|---|---|---|---|---|
| Diluted 1:10 WAS Aqueous Solution | Initial Surface Tension (mN/m) | Surface Tension After Grease Exposure (mN/m) | CMC - No Grease Exposure (ppm) | Retain CMC after Grease Droplet Exposure (ppm) |
| Sample B (10 ppm) | 60.13 | 25.72 | 68 | 4 |
| Sample E (10 ppm) | 70.21 | 40.02 | 395 | 346 |

These tests indicate a dramatic shift in CMC values, interfacial tension and surface tension when the ethoxylated alcohol nonionic surfactant is utilized with the protein component, but without the benefit of the anionic surfactant. However, the decline in the grease droplet volume reduction was not nearly as dramatic. The reduction of the grease droplet volume for Sample B (containing the anionic surfactant) was 28.6% versus a 22.4% decline for Sample E (sans the anionic surfactant), for a total loss in efficiency of 8%.

A mass balance was performed for Sample E based upon the grease volume lost. The volume decrease of the grease droplet was 1.12 ul (5.0 ul minus 3.88 ul) and was added to the WAS phase retains. This amounted to 22.4% of the grease, or 224 ppm. The CMC decrease, relative to the 10 ppm Sample B formulation, was 395−346=49 ppm. Stated otherwise, the CMC decreased by 49 ppm due to 224 ppm of the former grease materials being taken into the WAS phase. Thus, $^{49}/_{224}$, or 22.4% of the 22.4% of the grease droplet materials lost from the grease droplet become surfactant-like, interfacially active species, with the cleaning power of the order of the cleaning power of the Sample B formulation.

Comparison of Anionic Surfactant, with and without Protein Component Versus Sample B Containing Nonionic and Anionic Surfactants with Protein Component Using Motor Oil with Grease Droplet Volume Test Compositions were tested substituting Castrol 10W30 motor oil for the bacon grease utilized in the previous evaluations. This test was conducted so as to ascertain the differences in performance between petroleum products and animal grease and oil. The efficiency of cleaning compositions will vary, depending on the composition of the soil being removed from a substrate. Depending on the targeted soil composition, those skilled in the art will choose from a variety of surfactant types when formulating cleaning compositions for targeted applications. This study suggests that the performance of anionic surfactants, without the aid of nonionic surfactants, can be substantially improved when used in conjunction with the protein component.

Aerosol OT-75 (Sample F), an anionic surfactant whose composition is a dioctyl ester of sodium sulfosuccinic acid, was tested and compared with a formulated product (Sample G) in which the Aerosol OT-75 was formulated into a composition at a 10% concentration, and incorporating the protein component. These two samples were then compared directly to Sample B, using the Castrol motor oil as the grease/oil substrate.

These formulations are as follows:

| | Concentration (% by weight) | | |
|---|---|---|---|
| Component | Sample B | Sample F | Sample G |
| Water | 64.92 | 0 | 64.01 |
| Protein Component (Samples B and G only) (Product of fermentation of *saccharomyces cerevisiae*, U.S. patent application Ser. No. 10/799,529) | 20.00 | 0 | 20.00 |
| Inorganic Salts (e.g., diammonium phosphate, ammonium sulfate, magnesium sulfate, zinc sulfate, calcium chloride) | 0.31 | 0 | 0.31 |
| Aerosol OT (Anionic Surfactant) | 0 | 100.00 | 10.00 |
| Neodol 25-7 (Nonionic Surfactant) | 7.50 | 0 | 0 |
| Steal ES 603 (Anionic Surfactant) | 1.50 | 0 | 0 |
| Propylene Glycol | 5.30 | 0 | 5.30 |
| Sodium Benzoate | 0.10 | 0 | 0.10 |
| Methyl Paraben | 0.10 | 0 | 0.10 |
| Propyl Paraben | 0.03 | 0 | 0.03 |
| Ascorbic Acid | 0.08 | 0 | 0.08 |
| Calcium Chloride | 0.03 | 0 | 0.03 |
| BHA | 0.02 | 0 | 0.02 |
| BHT | 0.02 | 0 | 0.02 |
| Total | 100.00% | 100.00% | 100.00% |

Although these studies were conducted with unequal levels of the Aerosol OT-75, test results demonstrate that the addition of the protein component does modify the efficiency of the anionic surfactant so as to dramatically enhance the dissolution of the motor oil. For instance, Aerosol OT-75, used in its neat form at a concentration of 10 ppm, was able to reduce the motor oil droplet by 14% versus a reduction of 15.8% reduction for Sample B utilizing the nonionic/anionic composition and containing the protein component. This demonstrates that the efficiency of Aerosol OT-75 would be relatively effective for use in cleaning compositions formulated for removal of petroleum-based soils. However, when Aerosol OT-75 is utilized at only 10% of the composition, and coupled with the protein component, the amount of motor oil converted to soluble material is increased to 36.8%, for a 233% increase in efficiency.

These results are as follows:

| Effect of Aqueous Solutions at 5.0 ml on a 5.0 microliter Motor Oil Droplet | | | | | |
|---|---|---|---|---|---|
| Diluted 1:10 WAS Aqueous Solution | Initial Interfacial Tension with Bacon Grease (mN/m) | Equilibrium Interfacial Tension with Bacon Grease (mN/m) | Time Elapsed for Interfacial Tension Equilibration (minutes) | Equilibrium Grease Droplet Volume (ul) | Time Elapsed for Volume Equilibration (minutes) |
| Sample B (10 ppm) | 17.86 | 8.91 | >2800 | 4.21 | >2880 |
| Sample F (10 ppm) | 0.48 | 0.29 | >2800 | 4.30 | >2880 |
| Sample G (10 ppm) | 3.94 | 2.87 | >2880 | 3.16 | >2880 |

| Effect of 5.0 microliter Motor Oil Droplet on 5.0 ml Aqueous Solutions | | | | |
|---|---|---|---|---|
| Diluted 1:10 WAS Aqueous Solution | Initial Surface Tension (mN/m) | Surface Tension After Grease Exposure (mN/m) | CMC - No Grease Exposure (ppm) | Retain CMC after Grease Droplet Exposure (ppm) |
| Sample B (10 ppm) | 60.12 | 44.15 | 68 | 49 |
| Sample F (10 ppm) | 34.03 | 33.98 | No Test | No Test |
| Sample G (10 ppm) | 55.32 | 38.02 | 164 | 119 |

The results for interfacial tension for Samples F and G appear to be linear, in that Sample G, which contains 10% Aerosol OT-75 yielded initial interfacial tension results 8 times higher, and equilibrium interfacial tension 10 times higher than Sample F, which contained 10 times as much of the same anionic surfactant. While the initial surface tension Sample G was 62.3% greater than that of Sample F, the post-motor oil exposure for Sample F was virtually unchanged. Sample G, on the other hand, yielded a 31.3% reduction in surface tension after being exposed to the motor oil, and resulted in surface tension results only 11.9% greater than Sample F in spite of the fact that Sample F had a surfactant level 10 times greater than that of Sample G. These results indicate that cleaning products may be formulated with greater efficacy while utilizing much lower surfactant levels when formulating products containing the protein component.

A mass balance was performed for Sample G based upon the motor oil volume lost. The volume decrease of the motor oil droplet was 1.84 ul (5.0 ul minus 3.16 ul) and was added to the WAS phase retains. This amounted to 36.8% of the motor oil, or 368 ppm in the 5.0 mL solution. The CMC decrease, relative to the 10 ppm Sample G formulation, was 164−119=45 ppm. Stated otherwise, the CMC decreased by 45 ppm due to 368 ppm of the former motor oil materials being taken into the WAS phase. Thus, of the 36.8% of the motor oil droplet materials lost from the motor oil droplet, $^{45}/_{368}$, or 12.2% became surfactant-like, interfacially active species, with the cleaning power of the order of the Sample G formulation when utilized on petroleum-based soils.

Illustration of a Floor Cleaning Composition

A commercial floor cleaning composition that contains bacteria, designed for use in food preparation areas of restaurants, was evaluated against the same formulation wherein the bacteria spores were removed and the protein component was added at a level of 12%. The surfactant system utilized in the two formulations was both nonionic, consisting of an ethoxylated alcohol and alkyl polyglucoside combination. The formulae for the compositions tested are as follows:

| | Concentration (% by weight) | |
|---|---|---|
| Component | Sample H | Samples I |
| Water | 68.72 | 56.41 |
| Protein Component (Sample B only) (Product of fermentation of *saccharomyces cerevisiae*, U.S. patent application Ser. No. 10/799,529) | 0 | 12.0 |
| Inorganic salt (e.g., diammonium phosphate, ammonium sulfate, magnesium sulfate, zinc sulfate, calcium chloride) | 0 | 0.31 |
| Neodol ™ 91-6 (Non-ionic surfactant) | 13.25 | 13.25 |
| Glucopon 625 (Nonionic surfactant) | 17.80 | 17.80 |
| Sodium benzoate | 0.10 | 0.10 |
| Methyl paraben | 0.10 | 0.10 |
| Propyl paraben | 0.03 | 0.03 |
| Bacteria | Proprietary | 0 |
| Total | 100.00 | 100.00 |

Results of the studies demonstrated the ability of Sample I (containing the protein component) to significantly alter the interfacial tension and reduction of the grease drop volume beyond that achieved with Sample H (the commercial product). While the initial interfacial tension for Sample I was 4.4% higher that Sample H, the equilibrium interfacial tension declined by 67.8%, versus a 43.1% decline for Sample H. However, the reduction of the grease droplet volume is, from a practical application standpoint, much more significant. The data indicate the reduction of grease droplet volume for Sample H was only 4.8% versus a 16.8% reduction for Sample I. This represents a 3.5-fold increase in the grease-cleaning efficacy of the cleaning composition containing the protein component.

Effect of Aqueous Solutions at 5.0 ml on a 5.0 microliter Bacon Grease Droplet

| Diluted 1:10 WAS Aqueous Solution | Initial Interfacial Tension with Bacon Grease (mN/m) | Equilibrium Interfacial Tension with Bacon Grease (mN/m) | Time Elapsed for Interfacial Tension Equilibration (minutes) | Equilibrium Grease Droplet Volume (ul) | Time Elapsed for Volume Equilibration (minutes) |
|---|---|---|---|---|---|
| Sample H (10 ppm) | 12.72 | 7.24 | >2880 | 4.74 | >2880 |
| Sample I (10 ppm) | 13.28 | 4.27 | >2880 | 4.16 | >2880 |

Additionally, after exposure to the grease droplet, the data show shifts in surface tension and CMC values when the protein component is utilized in the formula, whereas the data for the commercial product remains virtually unchanged. Sample H (the commercial product) demonstrated a 1.7% reduction in surface tension for the post-grease droplet exposure data, and the CMC values also declined by a slight 1.9% to 257 ppm. Sample I, containing the protein component, exhibited a 15.6% reduction for the post-grease droplet exposure. Further, the initial CMC values were 30.5% lower than that of Sample H, and declined an additional 19.1%, resulting in a terminal CMC value of 153, or 40.5% lower that that of Sample I.

Effect of 5.0 microliter Bacon Grease Droplet on 5.0 ml Aqueous Solutions

| Diluted 1:10 WAS Aqueous Solution | Initial Surface Tension (mN/m) | Surface Tension After Grease Exposure (mN/m) | CMC - No Grease Exposure (ppm) | Retain CMC after Grease Droplet Exposure (ppm) |
|---|---|---|---|---|
| Sample H (10 ppm) | 52.92 | 52.04 | 262 | 257 |
| Sample I (10 ppm) | 55.02 | 46.45 | 189 | 153 |

The mass balance was performed for Samples H and I based upon the grease volume lost. A mass balance was performed for Sample G based upon the grease volume lost. The volume decrease of the grease droplet was 0.26 ul (5.0 ul minus 4.74 ul) and was added to the WAS phase retains. This amounted to 5.2% of the motor oil, or 52 ppm. The CMC decrease, relative to the 10 ppm Sample G formulation, was 262−257=5 ppm. Stated otherwise, the CMC decreased by 5 ppm due to 262 ppm of the former grease materials being taken into the WAS phase. Thus, of the 5.2% of the grease droplet materials lost from the grease droplet, $5/262$, or 1.9% became surfactant-like, interfacially active species. The mass balance, performed for Sample H based upon the grease volume lost, demonstrated the volume decrease of the grease droplet was 0.84 ul (5.0 ul minus 4.16 ul) and that the converted grease compounds were added to the WAS phase retains. This amounted to 16.8% of the grease, or 168 ppm. The CMC decrease, relative to the 10 ppm Sample G formulation, was 189−153=36 ppm. Stated otherwise, the CMC decreased by 36 ppm due to 168 ppm of the former grease materials being converted into the WAS phase. Thus, of the 16.8% of the grease droplet materials lost from the grease droplet, $36/168$, or 21.4% became surfactant-like, interfacially active species, with the cleaning power of the order of the Sample G formulation.

Effects on Biodegradability of Cleaning Compositions

There is widespread concern with the inability of many surfactants to biologically degrade in a timely fashion after they have been used and discarded. They are usually discharged to the municipal wastewater treatment facility or a septic system, which increases the loads on the municipal facility. In some cases, the discharge ends up in rivers and lakes, causing a build-up of nutrients that leads to algae growth and the general degradation of the ecosystem. As demonstrated in U.S. patent application Ser. No. 10/799,529, filed Mar. 11, 2004 now U.S. Pat. No. 7,476,529, entitled "Altering Metabolism in Biological Processes", the protein component, when used in conjunction with surfactants, can greatly enhance the degradation of carbonaceous contaminants in wastewater treatment plants. Tests were conducted to determine if the rate of biodegradation of a single nonionic surfactant, as measured by Biochemical Oxygen Demand, could be accelerated by inclusion if the protein component.

Tests were conducted by an independent testing laboratory, using test methods for determining Biochemical Oxygen Demand (EPA 405.1) (40 CFR 796-3200) to ascertain the degree to which the biodegradation of an ethoxylated alcohol (Neodol 25-7) can be accelerated when the protein component is coupled with the surfactant. The following formulae were tested.

| Component | Concentration (% by weight) Sample J | Samples K |
|---|---|---|
| Water | 69.59 | 89.90 |
| Protein Component (Sample B only) (Product of fermentation of *saccharomyces cerevisiae*, U.S. patent application Ser. No. 10/799,529) filed Mar. 11, 2004, now U.S. Pat. No. 7,476,529, | 20.0 | 0 |
| Inorganic salt (e.g., diammonium phosphate, ammonium sulfate, magnesium sulfate, zinc sulfate, calcium chloride) | 0.31 | 0 |
| Neodol ™ 25-7 (Non-ionic surfactant) | 10.0 | 10.0 |
| Sodium benzoate | 0.1 | 0.1 |
| Total | 100.00 | 100.00 |

The test results are as follows:

| SAMPLE | REDUCTION OF BIOCHEMICAL OXYGEN DEMAND (ppm) AMOUNT OF REDUCTION OF $BOD^5$ (ppm) |
|---|---|
| Sample J | 187,430 |
| Sample K | 99,480 |

These results demonstrate the ability of the protein component to greatly accelerate the degradation of surfactants and greatly reduce their impact on the environment. In addition, there are numerous surfactants in use today that are extremely effective but have relatively low biodegradability, such as nonyl phenols, and are being replaced with less effective surfactants with better biodegradability profiles. This sometimes works against the intent because higher levels of the less effective replacement surfactants are needed to complete the cleaning task. The net result is little or no benefit to the environment. It can be detrimental in the sense that the loads to the wastewater facility would increase due to the increased quantities of the less-effective surfactants. The protein component of the current invention would have the benefit of improving the environment and reducing the load to the wastewater treatment facility by providing a mechanism whereby the current surfactants could continue to be used.

Effects on Contaminants

Cleaning and degreasing compositions that include the protein component have been shown to reduce fats, oils, and greases (FOG), and other organic compounds in aqueous solutions, at levels greater than those attributable solely to the surfactants contained in those detergent compositions. Fats, oils, and greases are components of biological oxygen demand (BOD) and total suspended solids (TSS), two frequently used measures of wastewater contaminant levels. As a result, the detergent compositions of the present invention, including the protein component, have the advantageous benefit of reducing BOD and TSS in wastewater. Thus, incorporation of these detergents into aqueous waste streams, such as institutional, commercial, industrial, or municipal waste treatment facilities, will achieve beneficial decreases in contaminant levels, namely, BOD and TSS.

Utilization of cleaning compositions, including laundry detergents, would be of particular benefit in more rural settings where septic systems are typically used. Septic systems are prone to clogging due to fats, grease and cooking oils that find their way into the system. When the clogging occurs in the septic field, the wastewater is unable to percolate into the soil and generally results in the septic system backing up into the residence or business. In this case, the septic system must be cleaned or pumped out, usually at great expense. Continuous feeding of the septic system with cleaning agents containing the protein component will greatly help to alleviate this clogging effect.

In addition, the detergents may advantageously be used in waste transportation lines, such as sewer and drain lines. In such cases, effective treatment of the waste to obtain significant decreases in FOG, BOD, and TSS may occur while waste is being transported, and not only within the boundaries of the waste treatment facility itself. In effect, the transportation lines become part of the waste treatment facility and cause treatment to occur while the waste material is being transported to the primary facility.

All patents, patent applications, and literature references cited in this specification are hereby incorporated by reference in their entirety.

Thus, the compounds, systems and methods of the present invention provide many benefits over the prior art. While the above description contains many specificities, these should not be construed as limitations on the scope of the invention, but rather as an exemplification of the preferred embodiments thereof. Many other variations are possible.

Accordingly, the scope of the present invention should be determined not by the embodiments illustrated above, but by the appended claims and their legal equivalents.

The invention claimed is:

1. A surfactant composition comprising: a surfactant package of one or more surfactants, at least one of said one or more surfactants comprising a dioctyl ester of sodium sulfosuccinic acid, and a protein component having a concentration sufficient to substantially increase the surface activity of the one or more surfactants relative to the surface activity of the one or more surfactants in the absence of the protein component, wherein the protein component comprises a mixture of multiple intracellular proteins, at least a portion of the mixture includes yeast polypeptides obtained from a yeast fermentation process and yeast heat shock proteins resulting from subjecting a mixture obtained from the yeast fermentation process to heat stress.

2. The surfactant composition of claim 1, wherein said protein component comprises a composition of proteins having molecular weights of between about 5,000 and about 30,000 Daltons.

3. The surfactant composition of claim 1, wherein said yeast fermentation process is conducted under aerobic conditions.

4. The surfactant composition of claim 3, wherein said yeast fermentation process includes disrupting the cellular structure of a plurality of yeast cells to release intracellular proteins into the fermentation product.

5. The surfactant composition of claim 1, wherein said surfactant package comprises a nonionic surfactant.

6. The surfactant composition of claim 1, wherein said surfactant package comprises an amphoteric surfactant.

7. The surfactant composition of claim 5, wherein the nonionic surfactant is selected from the group consisting of dodecyl dimethylamine oxide, coco diethanol-amide alcohol ethoxylates, linear primary alcohol polyethoxylate, alkylphenol ethoxylates, alcohol ethoxylates, EO/PO polyol block polymers, polyethylene glycol esters, and fatty acid alkanolamides.

8. The surfactant composition of claim 6, wherein the amphoteric surfactant is selected from the group consisting of cocoamphocarboxyglycinate; cocamidopropylbetaine; betaines; imidazolines.

9. The surfactant composition of claim 1, further comprising a neutralizer.

10. The surfactant composition of claim 9, wherein said neutralizer comprises one or more of monoethanolamine (MEA), diethanolamine (DEA), or triethanolamine (TEA).

11. The surfactant composition of claim 1, further comprising a hydrotropic agent.

12. The surfactant composition of claim 11, wherein said hydrotropic agent comprises ethanol.

13. The surfactant composition of claim 1, further comprising a protein stabilizer.

14. The surfactant composition of claim 13, wherein said protein stabilizer comprises one or more of propylene glycol or borax.

15. The surfactant composition of claim 1, wherein the mixture of multiple intracellular proteins comprises the product of a fermentation of a plurality of yeast cells in the presence of a nutrient source.

16. The surfactant composition of claim 15, wherein the nutrient source comprises a sugar.

17. The surfactant composition of claim 16, wherein the nutrient source further comprises one or more of diastatic malt, diammonium phosphate, magnesium sulfate, ammonium sulfate zinc sulfate, and ammonia.

18. The surfactant composition of claim 15, wherein said plurality of yeast cells comprises one or more of *saccharomyces cerevisiae, kluyveromyces marxianus, kluyveromyces lactis, candida utilis, zygosaccharomyces, pichia*, or hansanula.

19. The surfactant composition of claim 15, wherein the plurality of yeast cells comprises *saccharomyces cerevisiae.*

* * * * *